US009718124B2

(12) United States Patent
Urhahn et al.

(10) Patent No.: US 9,718,124 B2
(45) Date of Patent: Aug. 1, 2017

(54) DEVICE FOR PRODUCING A CYLINDER CRANKCASE USING THE LOW-PRESSURE OR GRAVITY CASTING METHOD

(71) Applicant: KS HUAYU ALUTECH GMBH, Neckarsulm (DE)

(72) Inventors: Ludger Urhahn, Muehlbach/Eppingen (DE); Herbert Moeding, Bad Friedrichshall (DE); Eckhart Metzger, Bretzfeld (DE); Christian Klimesch, Karlsruhe (DE)

(73) Assignee: KS HUAYU ALUTECH GMBH, Neckarsulm (DE)

( * ) Notice: Subject to any disclaimer, the term of this patent is extended or adjusted under 35 U.S.C. 154(b) by 0 days.

(21) Appl. No.: 15/114,404

(22) PCT Filed: Jan. 15, 2015

(86) PCT No.: PCT/EP2015/050639
§ 371 (c)(1),
(2) Date: Jul. 27, 2016

(87) PCT Pub. No.: WO2015/113821
PCT Pub. Date: Aug. 6, 2015

(65) Prior Publication Data

US 2016/0339514 A1 Nov. 24, 2016

(30) Foreign Application Priority Data

Jan. 29, 2014 (DE) ..... 10 2014 101 080

(51) Int. Cl.
*B22D 18/04* (2006.01)
*B22D 15/02* (2006.01)
(Continued)

(52) U.S. Cl.
CPC ..... *B22D 18/04* (2013.01); *B22C 9/08* (2013.01); *B22C 9/082* (2013.01); *B22D 15/02* (2013.01);
(Continued)

(58) Field of Classification Search
CPC ..... B22D 15/02; B22D 15/04; B22D 18/04; B22D 23/02; B22D 25/02; B22D 35/04; B22D 37/00
(Continued)

(56) References Cited

U.S. PATENT DOCUMENTS 4,133,370 A * 1/1979 Bellocci ..... B22D 18/04 164/137
5,381,851 A * 1/1995 Bilz ..... B22D 18/04 164/119
7,134,479 B2 * 11/2006 Bend ..... B22C 9/082 164/136

FOREIGN PATENT DOCUMENTS

CN 201596759 U 10/2010
DE 10 2006 030 129 A1 1/2008
(Continued)

*Primary Examiner* — Kevin E Yoon
(74) *Attorney, Agent, or Firm* — Norman B. Thot

(57) ABSTRACT

A device for producing a cylinder crankcase using a low-pressure casting method or a gravity casting method. The device includes an outer casting mold which includes at least one mold part which, in an assembled state, forms a mold cavity that reproduces, for casting purposes, an outer contour of the cylinder crankcase. A region of the mold cavity forms a cylinder space of the cylinder crankcase. A dosing furnace contains a liquid metal. At least one gate is arranged geodetically below the mold cavity and via which the dosing furnace can be fluidically connected to the mold cavity. Sprue bushings project into the region of the mold cavity
(Continued)

that forms the cylinder space of the cylinder crankcase. Each of the at least one gate is connected to one of the sprue bushings.

17 Claims, 4 Drawing Sheets

(51) Int. Cl.

| | |
|---|---|
| ***B22C 9/08*** | (2006.01) |
| ***B22D 23/02*** | (2006.01) |
| ***B22D 15/04*** | (2006.01) |
| ***B22D 25/02*** | (2006.01) |
| ***B22D 31/00*** | (2006.01) |
| ***B22D 35/04*** | (2006.01) |
| ***B22D 37/00*** | (2006.01) |

(52) U.S. Cl.
CPC ..... *B22D 15/04* (2013.01); *B22D 23/02* (2013.01); *B22D 25/02* (2013.01); *B22D 31/00* (2013.01); *B22D 35/04* (2013.01); *B22D 37/00* (2013.01)

(58) Field of Classification Search
USPC ..... 164/119, 120, 306–311
See application file for complete search history.

(56) References Cited

FOREIGN PATENT DOCUMENTS

| | | | |
|---|---|---|---|
| DE | 10 2009 058 730 | A1 | 6/2011 |
| DE | 10 2011 056 985 | A1 | 6/2013 |
| DE | 10 2012 101 887 | A1 | 9/2013 |
| EP | 1 498 197 | A1 | 1/2005 |
| JP | 2003-211262 | A | 7/2003 |
| JP | 4086506 | B2 | 2/2008 |

* cited by examiner

DEVICE FOR PRODUCING A CYLINDER CRANKCASE USING THE LOW-PRESSURE OR GRAVITY CASTING METHOD

CROSS REFERENCE TO PRIOR APPLICATIONS

This application is a U.S. National Phase application under 35 U.S.C. §371 of International Application No. PCT/EP2015/050639, filed on Jan. 15, 2015 and which claims benefit to German Patent Application No. 10 2014 101 080.9, filed on Jan. 29, 2014. The International Application was published in German on Aug. 6, 2015 as WO 2015/113821 A1 under PCT Article 21(2).

FIELD

The present invention relates to a device for producing a cylinder crankcase using the low-pressure or gravity casting method, having an outer casting mold with mold parts which in the assembled state form a mold cavity which, for casting purposes, reproduces the outer contour of the cylinder crankcase, a dosing furnace containing liquid metal, and at least one gate which is arranged geodetically below the mold cavity and via which the dosing furnace can be fluidically connected to the mold cavity.

BACKGROUND

Internal combustion engines with cylinder benches of light metal alloys arranged in V-shape or in line with respect to each other are often fabricated using low-pressure die casting methods or gravity casting methods. Filling is typically performed with the crankcase standing upright, the cylinder being at the top, while the bearing bracket is situated at the bottom. It is further known to arrange the crankcases in a lying position during casting and to arrange the gates at the sides so as to be able to cool the bearing brackets and cylinder walls for an improved structure, as described, for example, in DE 10 2006 030 129 A1.

When casting in an upright state, the melt solidifies either from the cylinder head side towards the crank space or vice versa depending on the point of introduction of the melt into the cavity of the mold. In this regard, either the cylinder deck or the bearing brackets solidify more slowly than the respective other part, resulting in a coarser structure with reduced strength in the parts solidifying more slowly. Relatively long solidification paths further result from the arrangement of the gates, which in turn results in high tool temperatures necessary to provide a correct filling of the mold without formation of blowholes. Another difficulty when designing is to avoid a complete blocking of the feed path by the inner cores during casting, the number and complexity of the cores increasing in modern internal combustion engines.

In an attempt to provide the greatest possible bearing bracket strength via short solidification times, it has been suggested to fill the cylinder crankcase from below using the low-pressure method with the cylinder deck situated at the bottom and the bearing bracket in the upper region. EP 1 498 197 A1, for example, describes casting a crankcase for V-shaped internal combustion engines in an upside down orientation and to introduce the melt from below, i.e., from the cylinder side. To prevent blowholes, feeders are arranged outside the cavity forming the cylinder crankcase. Due to the upward directed movement towards the bearing bracket, the melt is in a cooled state near the eutectic temperature when it reaches the region of the bearing bracket where high cooling speeds result which, in turn, lead to a fine structure with small dendrite arm spacings. A fast solidification at the cylinder deck cannot, however, be achieved. The strength in the region of the bolt bosses is also insufficient since blowholes may form due to insufficient feed to these regions.

A low-pressure casting method for internal combustion engines with cylinders arranged in a V-shape is also described in DE 10 2011 056 985 A1 wherein the orientation for casting is selected so that the cylinders are directed downward to the gate. Casting is performed on the sides of the cylinders facing each other. The cylinders may be cooled using chill molds so that small dendrite arm spacings can be achieved both in the bearing bracket area and at the cylinder walls. The supply of melt to the large-volume parts of the cylinder crank case is, however, insufficient, in particular due to shrinking processes during cooling, so that insufficient strength is achieved in these regions or in the region of the bolt pipes.

No method is therefore currently known with which it is possible to achieve both small dendrite arm spacings in the region of the bearing bracket and the cylinder bore surfaces at the web regions and a high strength by avoiding blowholes in the region of the bolt bosses.

SUMMARY

An aspect of the present invention is to provide a device for producing a cylinder crankcase using low-pressure or gravity casting methods with which it is possible to obtain optimum structural properties in the bearing bracket region and in the region of the cylinder webs as well as in the region of the bolt bosses and the cylinder deck.

In an embodiment, the present invention provides a device for producing a cylinder crankcase using a low-pressure casting method or a gravity casting method. The device includes an outer casting mold comprising at least one mold part which, in an assembled state, forms a mold cavity that reproduces, for casting purposes, an outer contour of the cylinder crankcase. A region of the mold cavity forms a cylinder space of the cylinder crankcase. A dosing furnace is configured to contain a liquid metal. At least one gate is arranged geodetically below the mold cavity and via which the dosing furnace can be fluidically connected to the mold cavity. Sprue bushings are configured to project into the region of the mold cavity that forms the cylinder space of the cylinder crankcase. Each of the at least one gate is connected to one of the sprue bushings.

BRIEF DESCRIPTION OF THE DRAWINGS

The present invention is described in greater detail below on the basis of embodiments and of the drawings in which.

DETAILED DESCRIPTION

Figure 1:
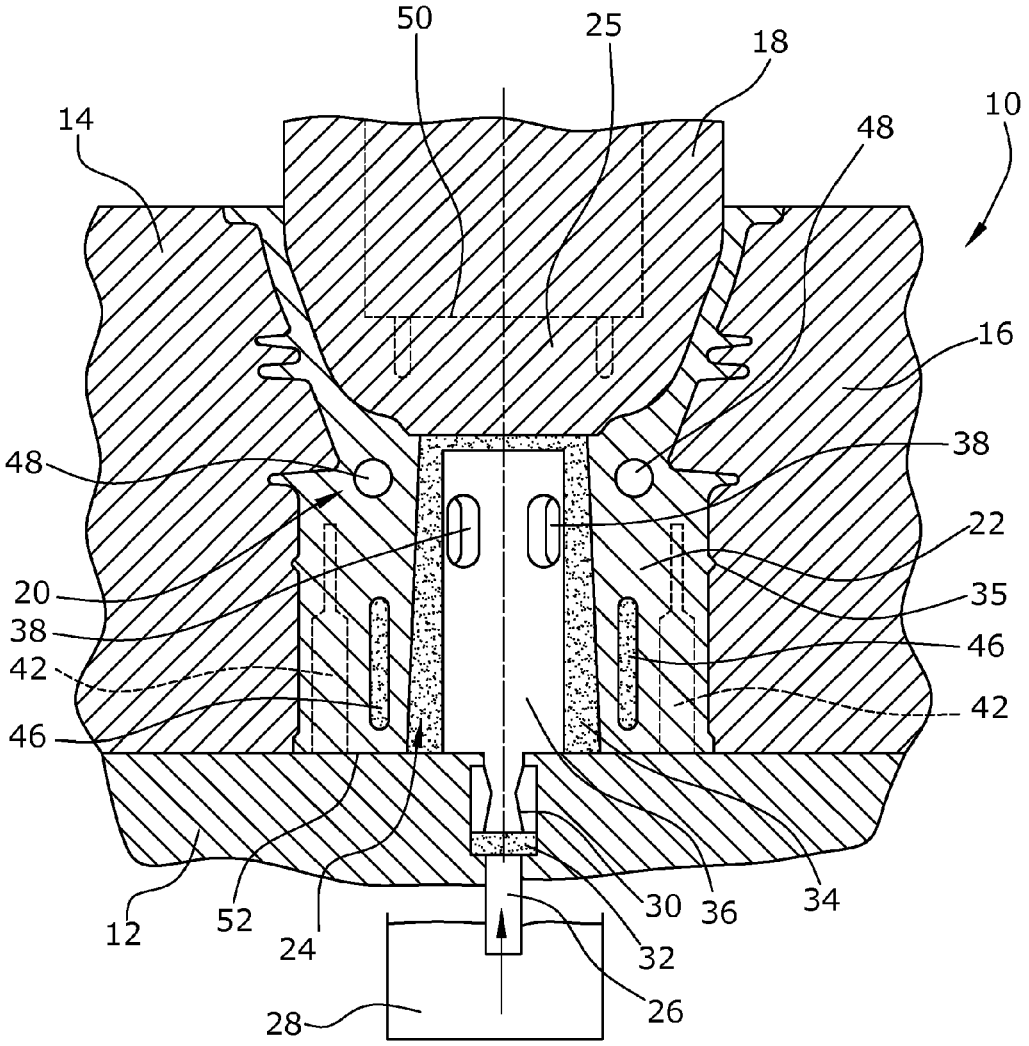
FIG. 1 shows a sectional side view of a detail of a first device for producing a cylinder crankcase according to the present invention.

Due to the fact that each gate is connected with a sprue bushing that projects into a region of the mold cavity forming a cylinder space of the cylinder crankcase, a directed solidification is obtained in the region of sections having a large mass, such as the bearing bracket and the bolt bosses, so that high strength values are obtained by short dendrite arm spacings in these regions. Due to the direct connection with the sprue bushing, these regions can at the same time be fed with additional melt during solidification via the sprue tubes, whereby blowholes are avoided that would be caused by shrinking during cooling.

The sprue bushings can advantageously be designed as lost sprue bushings which are pressed out from the crank space side after casting. The lost sprue bushings are made of fiber materials, ceramic materials, foundry molding materials, or a combination of these materials. A simple and economic production of the sprue bushings is thereby obtained.

In an embodiment of the present invention, the sprue bushings can, for example, have a cylindrical channel from which channels extend at an angle through the side walls defining the sprue bushing. A direct filling and feeding of the high-mass sections of the cylinder crankcase is performed via these channels, whereby high strength values are achieved.

A particularly simple production is obtained if the channels are designed as transversal channels that extend orthogonally to the cylindrical channel.

The channels can, for example, be arranged so that the channels are directed towards high-mass casting regions of the cylinder crankcase, whereby feeding additional melt to these regions is optimized.

The channels can advantageously be directed towards bolt bosses and/or main oil channels and/or the connecting sections between the main bearing sites and the cylinder spaces of the cylinder crankcase so that a directed filling and feeding of additional material is achieved in these regions and a cylinder crankcase with small dendrite arm spacings is produced.

In an embodiment of the present invention, the sprue bushings can, for example, be arranged on a mold part that delimits the cylinder deck, the side walls thereof serving at least in part as a delimiting wall for forming the cylinder space. The sprue bushes can thus be placed in a simple and exact manner due to the orientation during casting.

The sprue bushings can alternatively be fastened in a holding mold part extending into the cylinder space, the holding mold part serving at least in part to form a delimiting wall of the cylinder space. Placing the sprue bushings is thereby simplified and is done with high precision and good stability.

Chill molds can advantageously extend at least into regions of each cylinder space that are arranged near the cylinder deck or the webs. It is thereby possible to additionally achieve a directed fast solidification of the melt and a fine structure with a high strength in these regions critical in terms of strength. In the form of chills, these chill molds may also be fastened in the sprue bushings and placed into the mold together therewith.

In an embodiment of the present invention, the holding mold parts can, for example, be formed as chill molds that hold the sprue tube. A particularly simple connection of the sprue tube is achieved with this configuration.

A further improvement is obtained if the mold part on the cylinder deck side is made of steel and can be cooled in chill casting. A directed solidification by a short cooling time of the melt can thus also be achieved at the cylinder deck so that fine structures with high strength are obtained.

In an embodiment of the present invention, the holding mold parts can, for example, each have four axially extending arms forming a cylinder with an interrupted circumference, the arms being regularly distributed over the circumference. The sprue bushing can be fastened in a simple and reliable manner in a holding mold part of such a design. This body is also simple to manufacture.

For a simple demolding of the sprue bushing and a good cooling via the arms, an insulation insert is arranged in the radially inner region of the arms which has openings corresponding to the interruptions between the arms, wherein the mold is filled via these openings.

In an embodiment of the present invention, the interruptions can, for example, be directed diagonally towards the bolt bosses, whereby a good filling and feeding of these regions is provided and a cooling of the web region between the cylinders is provided via the holding mold parts so that good strength values are obtained.

It can be advantageous if the casting filter is arranged immediately below the gate or in the sprue bushing so that no oxides or other impurities are introduced into the cast part.

For a still further improved filling and feeding of the mold in core package and chill casting, the device can, for example, include components with which the mold or the core package can be turned by 180° and be decoupled from the dosing furnace after having been filled with the metal melt. The temperature gradient caused by the mold filling supports the directed solidification.

A device for producing a cylinder crankcase for internal combustion engines is thus provided with which a directed solidification is provided for the purpose of obtaining optimal structures and thus strengths in the regions where strength is critical, i.e., in the region of the bearing bracket, the bolt bosses, and in the web regions of the cylinders. The cooling can be achieved almost completely from the outer to the inner side or from the outer side towards the sprues, whereby the solidification times are minimized. Structure defects in the inner region are at the same time avoided by the feeder function of the sprue bushing.

Three embodiments of present invention devices for producing a cylinder crankcase with in-line configuration are schematically illustrated in the drawings as described below.

The device illustrated in FIG. 1 has an outer mold 10 consisting of a plurality of mold parts made of steel or foundry molding materials, the mold 10 having a bottom part 12, two side parts 14, 16, as well as an upper part 18, which, after the mold parts 12, 14, 16, 18 are placed or closed, form a mold cavity 20 on the inner side which represents an outer contour of a cylinder crankcase 22 whose cylinder spaces 24 are geodetically directed downward, while the bearing bracket 25 is directed upward.

The bottom part 12 has a filling system 26 via which the mold cavity 20 is connected with a dosing furnace 28 arranged below the mold 10. The machine is a low-pressure casting machine so that the supply of molten aluminum alloy from the dosing furnace 28 into the mold cavity 20 is effected by generating a differential pressure causing the melt to be moved upward from below.

The filling system 26 extends from the dosing furnace 28 to a plurality of gates 30, with one gate 30 being formed per cylinder, each gate 30 being arranged centrally beneath a respective cylinder space 24 of the cylinder crankcase 22. In chill casting, a casting filter 32 is arranged in the region of each gate 30, while in sand casting, the filter is arranged upstream of the inlet to the runner so that when filling the mold, the melt stream is deflected by 90° either upstream of the casting filter 32 or in the casting filter.

Each gate 30 is connected with a sprue bushing 34 which has a cylindrical shape in the embodiment shown in FIG. 1 and thus substantially reproduces the cylinder space 24 or delimiting walls 35 of the cylinders. These sprue bushings 34 are made of a ceramic material, fiber material, or a foundry molding material such as foundry sand or salt, or a combination of these materials, and are appropriately oriented and fastened on the bottom part 12.

In their interior, a cylindrical channel 36 is formed extending along the central axis of the cylinder. In the shown embodiment, four transversal channels 38 extend from the cylindrical channel 36 through the side walls 40 of the sprue bushings 34, the transverse channels opening into the mold cavity 20. These transversal channels 38 are distributed along the circumference corresponding to the mass concentration at the component and extend in the direction of bolt bosses 42 of the cylinder crankcase 22, i.e., they are orientated staggered diagonally relative to the cylinder webs of the cylinder crankcase 22, which are not visible in the drawing. The transversal channels 38 open into the mold cavity 20 above cores 46 for producing a coolant shell of the cylinder crankcase 22. These transversal channels 38 are thus directed towards the high-mass regions of the cylinder crankcase 22, such as the bolt bosses 42, the main oil channels 48 which are also formed by corresponding inserted cores, as well as the connections of the bearing bracket 25 with the main bearing sites 50 of the crankshaft.

If melt is lifted from the dosing furnace 28 into the sprue bushing 34 via the gate 30 by generating pressure, the melt flows into the mold cavity 20 through the transversal channels 38 and first fills the region of the downward directed cylinder deck 52, where a fast solidification is thus achieved, since no additional material flows into this region. The further filling then proceeds in a manner rising from bottom to top. The main bearing sites 50 as the highest parts are filled last, so that when these regions of the cylinder crankcase 22 are reached, the melt is already in the range of the eutectic temperature and thus solidifies rapidly, whereby fine structures with small dendrite arm spacings are achieved, which results in high strength. The general solidification direction thus is from the outside inward. The high-mass regions of the bolt bosses 42 and of the connection with the bearing block 25 remains in contact with the transversal channels 38 so that, as the cooling proceeds, additional material is fed via these from the outside inward, whereby the formation of blowholes by shrinkage is reliably prevented. A directed filling and solidification with good strength values is thus realized.

Figure 2:
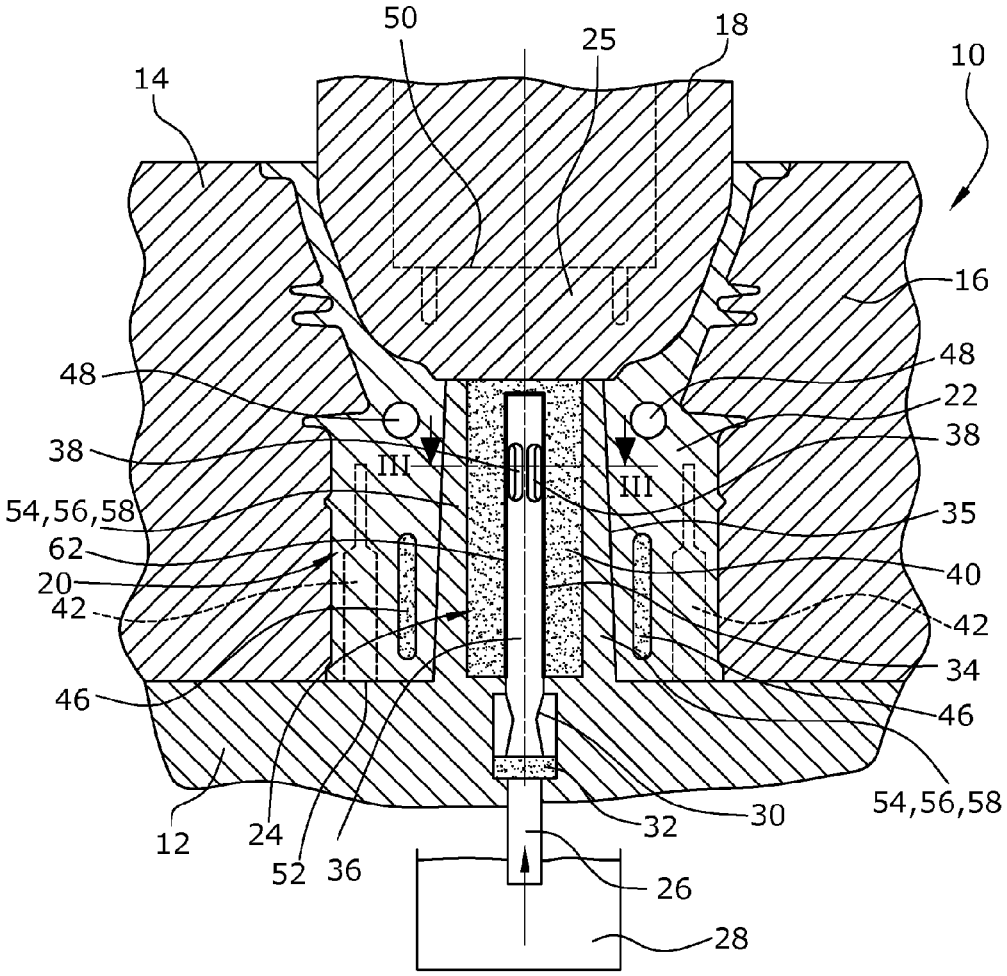
FIG. 2 shows a sectional view of a detail of an alternative device for producing a cylinder crankcase according to the present invention.
Figure 3:
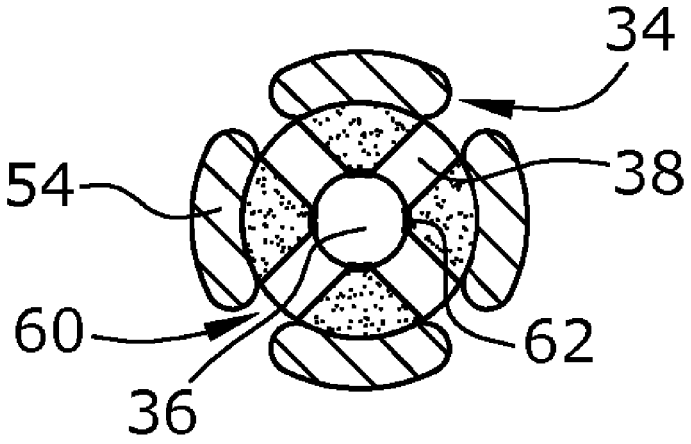
FIG. 3 shows a top plan view on the sprue bushing and the holding mold part along the sectional plane of FIG. 2.
Figure 4:
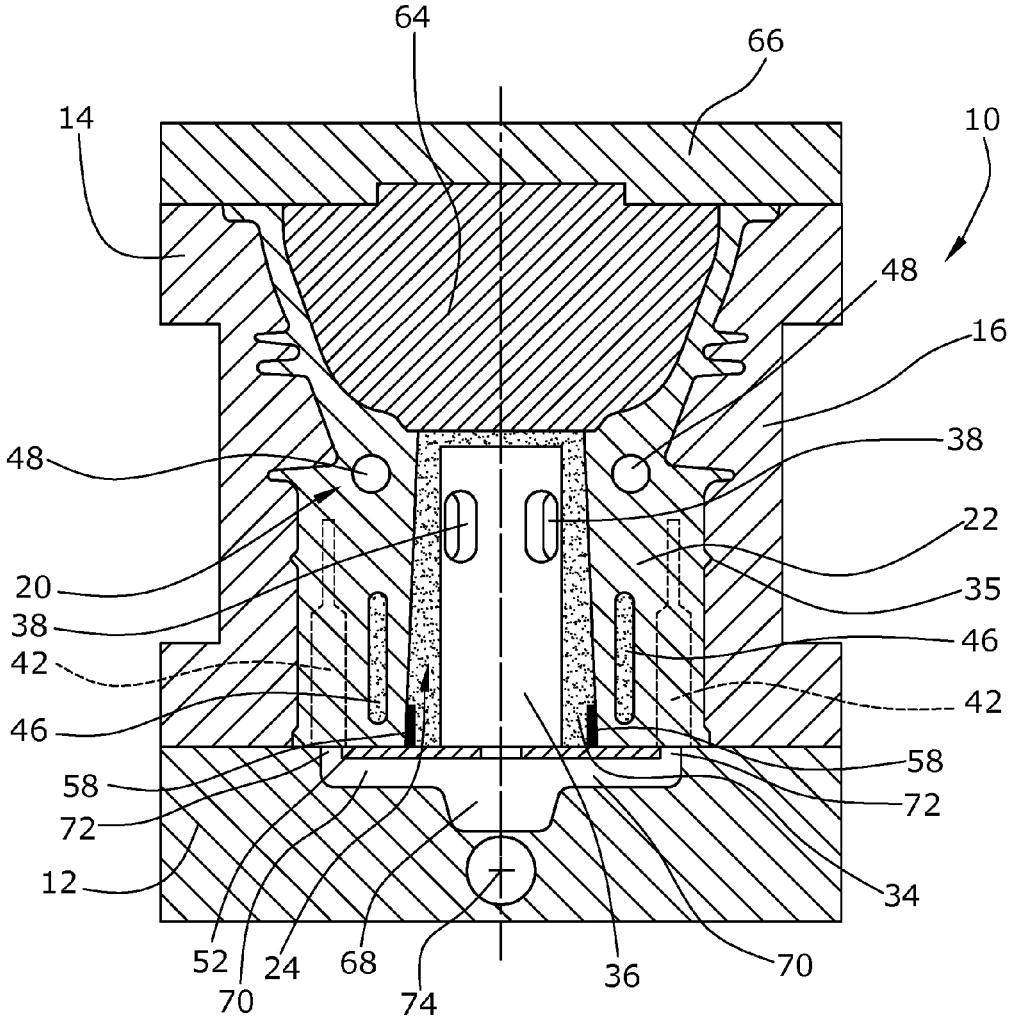
FIG. 4 shows a sectional side view of a detail of a third device for producing a cylinder crankcase according to the present invention.

An additional improvement of this casting result can be obtained with an embodiment as illustrated in FIGS. 2 and 3 where identical components are identified in the following by identical reference numerals. This embodiment differs from the above described embodiment in that the bottom part 12 of the mold 10 is made of steel and can be cooled, for example, via cooling channels which can be arranged inside the bottom part 12. This bottom part 12 also has holding mold parts 54 for each sprue bushing 34. These consist of four arms 56 regularly distributed over the circumference, which serve as a chill mold 58, receive the sprue bushing 34 radially and, by their height and width, define the delimiting wall 35 of the cylinder during casting, as can be seen in FIG. 3. The arms 56 correspondingly form a cylinder with interruptions 60 distributed over the circumference. The interruptions 60 are distributed over the circumference in the same manner as the transversal channels 38 of the sprue bushing 34. An insulation insert 62 is situated in the cylindrical channel 36, which also has corresponding recesses to allow filling and feeding, the insulation insert 62 reducing thermal transfer between the arms 56 serving as chill molds 58 and the sprue bushing 34.

Filling the mold cavity 20 is performed in the same manner as described in the first embodiment. However, still finer structures are achieved at the cylinder deck 52 and in the region of the cylinder webs since these regions are cooled directly and the solidification times are thus shortened. An additional active cooling may also be implemented in the region of the main bearing sites 50 resulting in reduced dendrite arm spacings and increased strength at the bearing bracket 25 as compared to the structures already achievable by the directed filling.

A sand mold package is used as the mold 10 in the shown embodiment. Compared to the embodiment shown in FIG. 1, a chill mold 64 is situated in the region of the bearing bracket 25, the chill mold being held by a cover core 66 as an additional mold part. The bottom part 12 is designed as a bottom core in which a runner 68 of the filling system 26, as well as the gates 30 leading to the sprue bushings 34. Chill molds 58 are formed at the sprue bushings 34 in the region of the cylinder deck 52. Transversal runners 70 additionally extend from the runner 68 that lead to auxiliary gates 72 via which lateral cylinder walls can also be filled. A rotation axis 74 is located parallel to the runner 68 in the region of the bottom part 12, about which rotation axis 74 the entire core package is turned by 180° after having been filled horizontally with melt and after the core package has been decoupled from the dosing furnace 28. This method is referred to as rotation casting or roll-over method.

Devices are accordingly provided with which a cylinder crankcase can be produced using low-pressure casting, wherein high strengths are achieved in the high-stress regions and reduced cycle times can be achieved since short cooling times and a directed filling are obtained. It is also possible to fill up high-mass regions with melt so that the formation of blowholes is counteracted.

It should be clear that the scope of protection is not restricted to the embodiments described above. The invention is also suited for gravity casting or for producing engines with cylinders arranged in a V-shape. Further structural modifications of the sprue bushing or the holding mold parts are of course also conceivable as the production of the mold parts from different materials that are cooled or not cooled. The position and the number of the transversal channels or their orientation may also be varied, for example, so that they may end below the water jacket cores. Reference should also be had to the appended claims.

What is claimed is:

1. A device for producing a cylinder crankcase using a low-pressure casting method or a gravity casting method, the device comprising:

an outer casting mold comprising at least one mold part which, in an assembled state, forms a mold cavity that reproduces, for casting purposes, an outer contour of the cylinder crankcase, a region of the mold cavity forming a cylinder space of the cylinder crankcase;

a dosing furnace configured to contain a liquid metal;

at least one gate arranged geodetically below the mold cavity and via which the dosing furnace can be fluidically connected to the mold cavity; and sprue bushings configured to project into the region of the mold cavity that forms the cylinder space of the cylinder crankcase, wherein, each of the at least one gate is connected to one of the sprue bushings.

2. The device as recited in claim 1, wherein the sprue bushings are lost sprue bushings.

3. The device as recited in claim 2, wherein the lost sprue bushings are made of a fiber material, a ceramic material, a foundry molding material, or a combination thereof.

4. The device as recited in claim 1, wherein the sprue bushings are defined by side walls, the sprue bushings comprising a cylindrical channel from which channels extend at an angle through the side walls.

5. The device as recited in claim 4, wherein the channels are formed as transversal channels which extend orthogonally to the cylindrical channel.

6. The device as recited in claim 4, wherein, the cylinder crankcase comprises high-mass casting regions, and the channels are directed towards the high-mass casting regions.

7. The device as recited in claim 6, wherein, the cylinder crankcase further comprises main bearing sites, the high mass casting regions comprise bolt bosses, main oil channels, and connecting sections between the main bearing sites and the cylinder spaces of the cylinder crankcase, and the channels are directed towards at least one of the bolt bosses, the main oil channels and the connecting sections between the main bearing sites and the cylinder space of the cylinder crankcase.

8. The device as recited in claim 7, further comprising:

a cylinder deck, wherein, the sprue bushings further comprise side walls, the sprue bushings are arranged on the at least one mold part which delimit the cylinder deck, and the side walls of the sprue bushings in part serve as a delimiting wall forming the cylinder space.

9. The device as recited in claim 8, wherein, the cylinder crankcase further comprises cylinder webs, and further comprising:

chill molds configured to protrude at least into a region of the cylinder space arranged near the cylinder deck or the cylinder webs.

10. The device as recited in claim 8, wherein the at least one mold part is arranged on a side of the cylinder deck side is made of steel and is configured to be cooled.

11. The device as recited in claim 8, further comprising:

a holding mold part configured to extend into the cylinder space and to in part form the delimiting wall of the cylinder space.

12. The device as recited in claim 11, further comprising:

holding mold parts designed as the chill molds.

13. The device as recited in claim 12, wherein each of the holding mold parts comprise four axially extending arms forming a cylinder with interruptions over the circumference thereof, the four axially extending arms being regularly distributed over the circumference.

14. The device as recited in claim 13, further comprising:

an insulation insert arranged in an inner region of the four axially extending arms, the insulation insert comprising recesses which correspond to the interruptions between the four axially extending arms.

15. The device as recited in claim 14, wherein the interruptions are directed diagonally towards the bolt bosses.

16. The device as recited in claim 1, further comprising:

a casting filter arranged immediately below the at least one gate or in one of the sprue bushings.

17. The device as recited in claim 1, further comprising components which are configured so that, after a filling with the metal melt, a core package can be turned by 180° and be decoupled from a dosing furnace.

* * * * *